United States Patent [19]

Paulsen

[11] 4,285,191

[45] Aug. 25, 1981

[54] QUICK STRANDING MACHINE

[76] Inventor: Günther Paulsen, Gingener Str. 22, 7000 Stuttgart 60, Fed. Rep. of Germany

[21] Appl. No.: 129,281

[22] PCT Filed: Dec. 16, 1978

[86] PCT No.: PCT/DE78/00041

§ 371 Date: Aug. 21, 1979

§ 102(e) Date: Aug. 20, 1979

[87] PCT Pub. No.: WO79/00414

PCT Pub. Date: Jul. 12, 1979

[30] Foreign Application Priority Data

Dec. 21, 1977 [DE] Fed. Rep. of Germany ..... 2756933

[51] Int. Cl.[3] ..... D07B 7/06; D07B 3/02; D07B 3/04

[52] U.S. Cl. ..... 57/58.34; 57/58.72; 57/58.81

[58] Field of Search ..... 57/58.3–58.38, 57/58.72–58.81, 127.5, 127.7

[56] References Cited

U.S. PATENT DOCUMENTS

| | | | |
|---|---|---|---|
| 2,463,887 | 3/1949 | Langstreth | 57/58.81 X |
| 2,499,245 | 2/1950 | Harmon | 57/58.36 X |
| 2,499,246 | 2/1950 | Harmon | 57/58.36 X |
| 2,499,258 | 2/1950 | Pierce | 57/58.36 X |
| 3,641,755 | 2/1972 | Heinen et al. | 57/58.34 X |
| 3,785,139 | 1/1974 | Groza et al. | 57/58.34 |

FOREIGN PATENT DOCUMENTS

| | | | |
|---|---|---|---|
| 210710 | 3/1968 | U.S.S.R. | 57/58.34 |

*Primary Examiner*—Donald Watkins
*Attorney, Agent, or Firm*—Michael J. Striker

[57] ABSTRACT

A high-speed stranding machine has a hollow rotor, at least one spool carrier arranged in the rotor independently of the rotation of the rotor, and an unbalanced mass preventing rotation of the spool carrier together with the rotation of the rotor and formed as a counterweight. The spool carrier with a spool carried thereby has a center of gravity substantially coinciding with the axis of rotation of the rotor, and the counterweight is connected with the spool carrier in such a manner that the counterweight can independently rotate about the axis of rotation of the rotor, and can be disconnected from the spool carrier upon exceeding a predetermined torque in a connecting element which connects the counterweight with the spool carrier.

9 Claims, 3 Drawing Figures

13
15
14
16
11
10
9
12
8
7
4

QUICK STRANDING MACHINE

BACKGROUND OF THE INVENTION

This invention relates to a high-speed stranding machine with at least one spool carrier held in floating bearings, prevented from rotating together with the rotor, inside which it is located, by an unbalanced weight. With these machines, known for example from the German Letters Patent DT-PS No. 23 37 305, the rotor is driven at high speeds. A wire runs off from every spool inside the rotor, the spools being supported so they can rotate by the spool carrier which itself is not rotating together with the rotor. The wires from all spools of the machine are led out of the rotor to the point of combination and are stranded there by the rotation of the rotor.

In order to ensure that the spool carrier will not rotate together with the rotor, it is, with the machines known, designed asymmetrical, so that its center of gravity will be located below its axis of rotation. Thus, its position during normal operation will be stable and it will just swing lightly to and fro. In case of the swinging becoming too large, a so-called swing safety will cause emergency braking and shutting-down of the machine.

It is also known how to arrange the position of the spool below the axis of rotation of the spool carrier, this in order to prevent the spod carrier from co-rotating.

Yet, malfunctioning during operations, when the spool carrier may come into rotation, cannot be eliminated altogether. An acceleration of the spool carrier may be caused by a defective spool-carrier bearing, by a broken wire or by a wire that has become wedged between the spool carrier and the rotor. The speed of rotation which the spool carrier will reach, depends upon the ratio of the momentum of inertia of the rotor to that of the spool carrier with spool, upon the braking time and upon the torque generated between rotor and spool carrier when, for instance, seizure occurs in a bearing. If such a torque is very high (magnitude of 10,000 N.m), acceleration will be so high that the spool carrier will approximately reach the full rotor speed, although the swing safety will respond correctly. Very high stresses by the centrifugal forces will result as a consequence and will be transmitted, via the spool carrier bearings onto the rotor, the rotor supports and the foundation which may be damaged or destroyed within fractions of a second. A rotor supported by trunnion rollers would be lifted from these rollers. The centrifugal force acting upon the locking parts of the spool carriers may be of such magnitude that the lock will open; the spool would then fly out. The stress exerted upon the spool-carrier wall by the centrifugal force resulting from its own weight and from the spool which is unevenly wound and displaced from the center, may be so large that with customary spool holders, the bending stress will be higher than the breaking limit.

SUMMARY OF THE INVENTION

It is the task of the invention, to construct a high-speed stranding machine in such a manner that on one hand the spool carrier will be reliably prevented from rotating with the rotor during operation, and on the other, that the stresses occurring in case of malfunction will be held within such limits that they can be accepted by the machine without damage or even destruction of individual parts.

This task is solved by locating the center of gravity of the spool carrier with the inserted spool, essentially within the axis of the rotor, and by coupling to the spool carrier an unbalanced mass which will prevent its rotation, consisting of a counterweight which can independently rotate about the axis of the rotor, and which may, on exceeding a predetermined value of the torque in the clutch to the spool carrier, become uncoupled from the latter.

By the invention, the centrifugal forces that occur, will be reduced to such an extent, that the stresses generated in case of malfunctioning by the swing safety shutting-down the machine, are so reduced that no danger exists for the machine or for the operator. If, for example, a spool carrier bearing should seize, the spool carrier may be accelerated so high that it will rotate with the speed of the rotor, but as soon as the predetermined value of the torque in the clutch between the spool carrier and the counterweight has been exceeded, this connection is broken. By suitable setting of the value of the torque, it is simple to achieve that during normal operation the counterweight, acting as stabilizing unbalanced mass, will be coupled to the spool carrier with sufficient security, while the torque that will be transmitted to the counterweight by the spool carrier when coming into rotation, may be kept so small that the maximum speed of the counterweight that may be reached until the machine comes to a stop, will be only a fraction of the rotor speed, wherein no dangerous stresses can occur. Rotating of the spool carrier with the rotor, the center of gravity of the former—without the unbalanced mass coupled to it—lying as per invention in the axis of the rotor, will not cause any additional dangerous stresses.

By the characteristics of the claim 2, it is made possible to have the spool carrier of an essentially symmetrical design and to have the center of gravity, with a spool inserted, always lying in the axis of the rotor, independently from the spool in the spool carrier being full or empty.

A perticularly exact setting of the value of the torque at which, as per invention, the counterweight is released from the spool carrier, can be achieved by a torque clutch, for example by spring-loaded balls or discs. Since however, the machine will anyway come to a stop in case of a malfunction, a shear bolt as per claim 4, which will become destroyed when the torque it is to transmit is exceeded, and which will thus release the counterweight, may be used as a particularly simple element to connect the counterweight to the spool carrier. When checking, and, in case of need, re-setting the machine, a new shear bolt may subsequently be inserted without any particular expenditure of time or of installing labor.

It is of particular advantage to support the counterweight as per claim 5 on the trunnion ring of spool carrier bearing so that it can rotate, because in normal operation this bearing is stationary, and, after releasing of the counter weight, only relatively low speeds can be reached, so that this bearing will not be subjected to a high load.

In order to design the balanced mass of the counter weight as small as possible, it is, as per claim 7, connected with the bearing by a lever that is as long as possible.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENT

Figure 1:
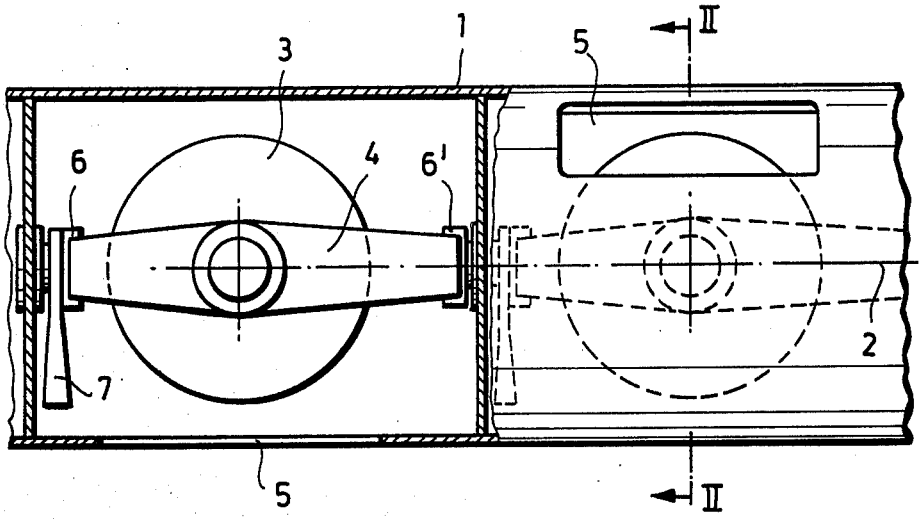
FIG. 1 is, in a schematic view, a part of the rotor of a high-speed stranding machine with two spools arranged in succession, and with their spool carriers.
Figure 2:
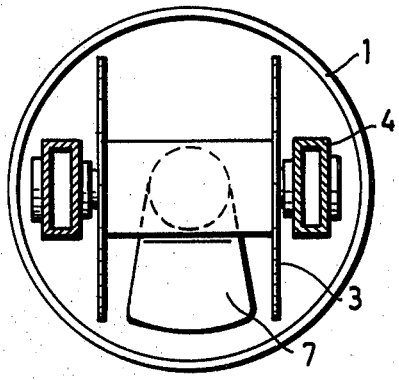
FIG. 2 is a section through FIG. 1 along the line II—II.

In FIG. 1, two spools are arranged in succession, supported so they can rotate each in the spool carriers 4, within a rotor 1 of a high-speed stranding machine which—depending upon the size of the machine—will rotate about the rotor axis 2 at speeds that may range from 1000 rpm to 5000 rpm. To allow changing of the spools 3, windows 5 are provided in the rotor wall. The spool carriers 4 are essentially symmetrical spool supports, the axis of rotation of which coincides with the rotor axis 2. The axes of the spools 3 intersect, as can also be seen from FIG. 2. The rotor axis 2. This makes possible that the center of gravity of the spool carrier 4 when carrying a spool 3, will be located exactly in the rotor axis 2 so that any imbalance is avoided, independent from the spool 3 being full or whether more or less wire has already been reeled off. If such a spool carrier 4 with spool 3 should be accelerated and even rotate at the full rotor speed, the momentary load exerted upon the spool carrier bearings 6, 6′ will not exceed their carrying capacity. The bearing forces will be transmitted via the rotor 1 onto the rotor bearing which is not shown. The stress upon the rotor 1 is so small that the stress upon the remaining sectional area of the rotor wall between the rotor windows 5, will be only slightly above the normal stress.

A counterweight 6 is arranged on the spool carrier bearing 6. It is connected with the spool carrier 4 and thus forms an unbalanced mass hindering the spool carrier 4 from rotating together with the rotor 1. Should the spool carrier 4 be accelerated by a broken wire, a defect in one of the spool carrier bearings 6, 6′ or by something of a similar nature, so that it begins to co-rotate, the connection between the counterweight 7 and the spool carrier 4 will be broken upon exceeding of a predetermined value of the torque in the clutch between these two parts.

Figure 3:
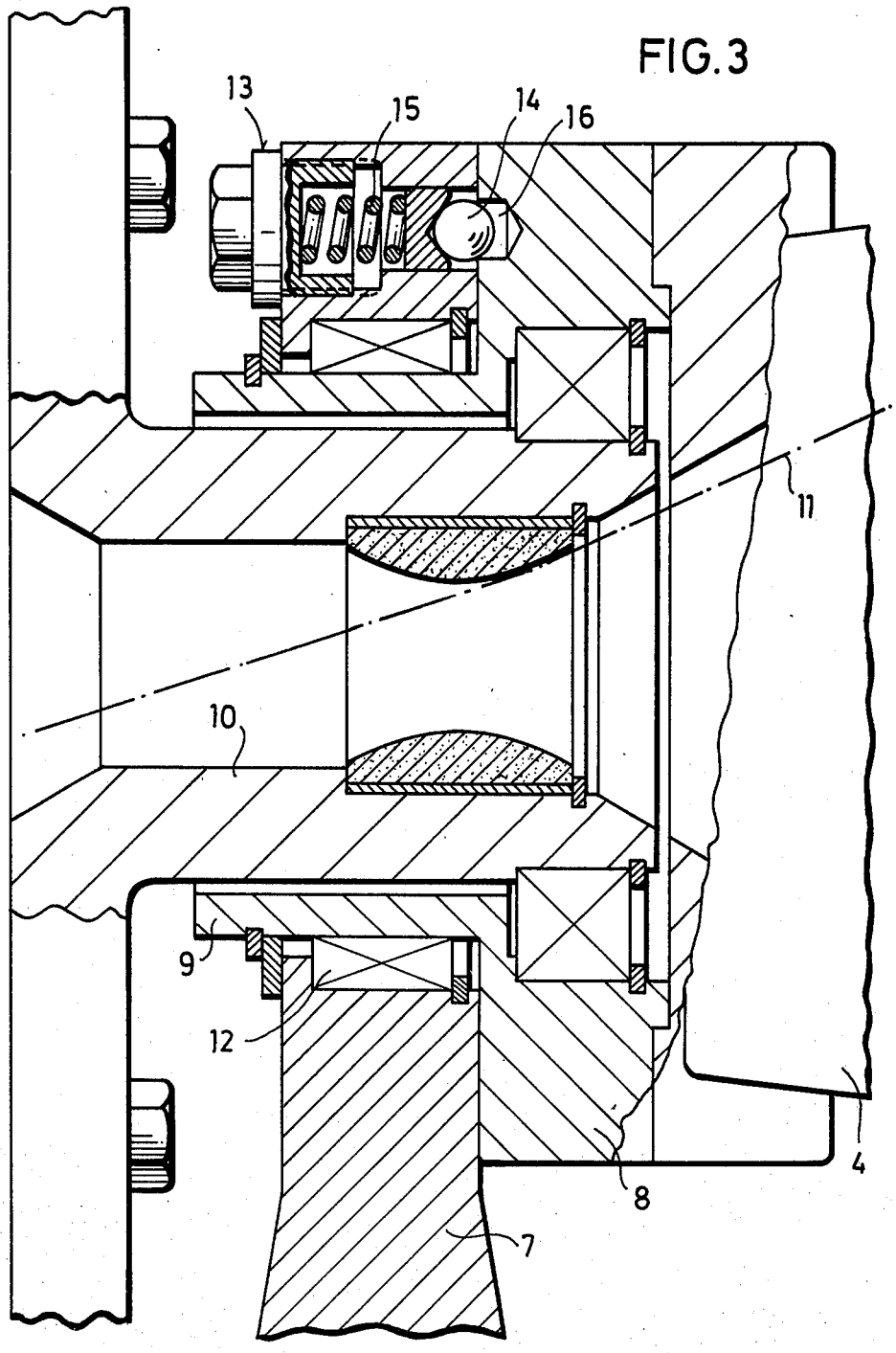
FIG. 3 is a sectional drawing of the spool carrier bearing with the counterweight connected.

In FIG. 3, the spool carrier bearing 6 on which the counterweight 7 is arranged, is shown in detail in a particularly advantageous arrangement as per claim 6. The trunnion ring 8 has a collar 9 on its side opposite to the spool not shown, and to the spool carrier 4 respectively, which holds the former. This collar 9 encloses, at a small distance, the hollow trunnion 10 of the spool carrier bearing 6, which is arranged on the rotor 1 and through which the wire 11 which is being unwound from the spool 3 is lead out. The outer jacket of the collar 9 forms the inner race of an antifriction bearing 12 in which the counterweight 7 is so supported that it can rotate. During normal operation, the bearing 12 is however held stationary by the counterweight 7 being connected to the trunnion ring 8 by a torque clutch 13 in such a manner that no rotation is possible. The torque clutch 13 in FIG. 3 consists of a minimum of one ball 14 which is pressed by the spring 15 into a bore 16 in the trunnion ring 8. By an appropriate design of this spring loading, it is possible to make a very exact setting of the torque value at which the ball 14 will slide out of the bore 16, thus releasing the counterweight 7, so that it may rotate freely in the bearing 12 relative to the spool carrier 4, and will not participate in a further occurring acceleration of the spool carrier 4.

Instead of the spring-loaded torque clutch 13 shown in FIG. 3, the connection between the counterweight 7 and the trunnion ring 8 may also be made by means of a shear bolt, the thickness of which must be so designed that it will break at the predetermined value of the torque. Since the malfunctions against whose effects the design of the quick stranding machine as per invention is to protect, do not occur very frequently, a new shear bolt may simply be inserted in such a case during the shut-down of the machine which will then occur anyway.

In order to hold as low as possible the load stress of the spool carrier bearing 6 by the counterweight 7 arranged on it, the lever arm by which the unbalanced mass of the counterweight 7 is connected to the counterweight bearing 12 should, as per claim 7, be as long as possible, and thus, a relatively small mass will attain an imbalance that will prevent a co-rotation of the spool carrier 4 with the necessary degree of security. The possible length of the lever is limited by the design of the machine, that means by the free space in the rotor 1 that is available for the counterweight 7.

It will be understood that each of the elements described above, or two or more together, may also find a useful application in other types of constructions differing from the types described above.

While the invention has been illustrated and described as embodied in a quick-stranding machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high-speed stranding machine, comprising a hollow rotor rotatable about an axis of rotation; at least one spool carrier arranged in said rotor independently of the rotation of said rotor; an unbalanced mass arranged to prevent rotation of said spool carrier together with the rotation of said rotor and formed as a counterweight, said spool carrier with a spool carried thereby having a center of gravity substantially coinciding with said axis of rotation of said rotor; and means for connecting said counterweight with said spool carrier so that said counterweight can independently rotate about said axis of rotation of said rotor, and can be disconnected from said spool carrier upon exceeding a predetermined torque value in said connecting means.

2. A high-speed stranding machine as defined in claim 1, wherein said connecting means includes a clutch connection.

3. A high-speed stranding machine as defined in claim 1, wherein said spool carrier is arranged so that a spool carried thereby has an axis which intersects said axis of rotation of said rotor.

4. A high-speed stranding machine as defined in claim 1, wherein said connecting means is formed as an adjustable torque clutch connecting said counterweight with said spool carrier.

5. A high-speed stranding machine as defined in claim 1, wherein said connecting means is formed as a shear bolt connecting said counterweight with said spool carrier.

6. A high-speed stranding machine as defined in claim 1; and further comprising a bearing which supports said spool carrier in said rotor and has a trunnion ring, and means for rotatably supporting said counterweight in said rotor and including said trunnion ring arranged to rotatably support said counterweight.

7. A high-speed stranding machine as defined in claim 6, wherein said trunnion ring has a side facing away from said spool carrier and is provided with a collar at said side, said counterweight supporting means including a further bearing with an inner race formed by said collar.

8. A high-speed stranding machine as defined in claim 1; and further comprising means for rotatably supporting said counterweight in said rotor, said counterweight supporting means including a lever which is connected with said counterweight for joint rotation therewith and elongated in direction from said axis of rotation of said rotor toward said counterweight.

9. A high-speed stranding machine as defined in claim 8, wherein said rotor has an inner hollow of a predetermined radial dimension, said lever of said counterweight supporting means having a length which substantially corresponds to said radial dimension.

* * * * *